US005798199A

United States Patent [19]

Bilbrey et al.

[11] Patent Number: 5,798,199

[45] Date of Patent: Aug. 25, 1998

[54] DRY XEROGRAPHIC TONER AND DEVELOPER

[75] Inventors: David Brian Bilbrey, Westminster; Rick Owen Jones, Berthoud; George Pharris Marshall, Boulder; Michael Gordon Miller; James Craig Minor, both of Longmont, all of Colo.

[73] Assignee: Lexmark International, Inc., Lexington, Ky.

[21] Appl. No.: 868,323

[22] Filed: Jun. 3, 1997

[51] Int. Cl.[6] ..... G03G 9/087

[52] U.S. Cl. ..... 430/110

[58] Field of Search ..... 430/110, 108, 430/109, 111

[56] References Cited

U.S. PATENT DOCUMENTS

| | | | |
|---|---|---|---|
| 3,879,196 | 4/1975 | Nagashima et al. | 96/1.2 |
| 4,598,034 | 7/1986 | Honjo et al. | 430/106.6 |
| 4,652,509 | 3/1987 | Shirose et al. | 430/110 |
| 4,883,735 | 11/1989 | Watanabe et al. | 430/109 |
| 4,943,507 | 7/1990 | Takahashi et al. | 430/120 |
| 4,977,054 | 12/1990 | Honjo et al. | 430/108 |
| 4,996,126 | 2/1991 | Anno et al. | 430/106.6 |
| 5,204,204 | 4/1993 | Shintani et al. | 430/108 |
| 5,395,726 | 3/1995 | Tavernier et al. | 430/124 |
| 5,464,722 | 11/1995 | Tomiyama et al. | 430/137 |
| 5,545,501 | 8/1996 | Tavernier et al. | 430/110 |
| 5,633,108 | 5/1997 | Christy et al. | 430/110 |

FOREIGN PATENT DOCUMENTS

| | | | |
|---|---|---|---|
| 0 628 883 B1 | 9/1993 | European Pat. Off. | G03G 9/097 |
| 2 113 413 | 8/1983 | United Kingdom | G03G 9/08 |

*Primary Examiner*—John Goodrow
*Attorney, Agent, or Firm*—John A. Brady

[57] ABSTRACT

A high speed toner comprising a body of hybrid resin which is about 92 percent by weight polyester and 8 percent by weight polystyrene. Blended in the resin is a charge control agent, a pigment, and about 10 percent by weight of the toner of fumed aluminum oxide. Where the pigments are color-subtractive the charge control agent is a copolymer of styrene and 2-acrylamido-2-methylpropane sulfonic acid.

The toner is mixed with a carrier of ferrite particles having a thick silicone coating to remain through the long life of the toner.

14 Claims, No Drawings

DRY XEROGRAPHIC TONER AND DEVELOPER

DESCRIPTION

1. Technical Field

This invention relates to dry, powdered xerographic toners and developers comprising a blend of materials which combine to function at high operating speeds with long life.

2. Background of the Invention

Dry xerographic toners are conventionally a blend of resin or resins for body, coloring matter for imaging, charge influencing materials and, where desirable, minerals as extenders. Often such dry, powdered materials are coated on their surface with much smaller mineral powders, such as fumed silica, to promote flow. When the toner is combined with particles much larger than the toner particle, typically polymer coated beads, the combination is termed a developer, and the large particle is termed a carrier.

charge control agent, which in the case of toner with color-subtractive pigments is a copolymer of styrene and 2-acrylamido-2-methylpropane sulfonic acid, a known charge control agent. In the case of the black toner with carbon black the charge control agent is E-84, a product of Orient Chemical Corp. Additionally, the toners have fumed aluminum oxide blended in the resin.

The resulting toner functions very well at high speed. It is combined with a silicone coated ferrite carrier with the coating thickness being large enough to remain throughout the long life.

BEST MODE FOR CARRYING OUT THE INVENTION

The preferred separate black and three color toner formulas are shown in the following Table 1. Percents given are percents by weight.

TABLE 1

| | | | Toner | | | |
|---|---|---|---|---|---|---|
| Component | Function | Manufacturer | Cyan | Magenta | Yellow | Black |
| TUFTONE HB-L4 | Binder resin | Kao Corporation | 84% | 81% | 82% | 84.5% |
| FCA 1001NS | CCA | Polytribo Corporation | 3' | 3 | 3 | 0 |
| BONTRON E-84 | CCA | Orient Chemical Corporation | 0 | 0 | 0 | 0.5 |
| HOSTAPERM Blue B2G | Cyan pigment | Hoechst-Celanese Corporation | 3 | 0 | 0 | 0.5 |
| CHEMISPERSE Magenta 3238 | Magenta pigment | Aztech Color Corporation | 0 | 6 | 0 | 0 |
| Permanent Yellow GG | Yellow pigment | Hoechst-Celanese | 0 | 0 | 5 | 0 |
| R 1020 carbon black | Black pigment | Columbian Chemical Corporation | 0 | 0 | 0 | 4.5 |
| Aluminum Oxide C | Inert filler | De Gussa Corporation | 10 | 10 | 10 | 10 |

The resin body of the toner of this invention is a hybrid resin, and its incorporation in a toner is believed unique. Product literature of the source of the specific resin used addresses generally that the hybrid balances charge problems associated with polyesters. Known charge control agents are employed in the toner of this invention. The toner of this invention employs powdered aluminum oxide, which, in itself, is not novel as illustrated by the following references: U.S. Pat. Nos. 5,545,501 to Tavernier et al., 5,464,722 to Tomiyama et al., 5,395,726 to Tavernier et al., 4,943,507 to Takahashi et al., 4,652,509 to Shirose et al., and 3,879,196 to Nagashima et al.; European Patent No. 0 628 83 B1 published Dec. 14, 1994, inventors Tavernier et al.; and UK Patent Application 2 113 413 A published Aug. 3, 1983, inventors Lupu et al.

This invention employs a ferrite body with silicone coating. Such carriers are generally conventional, as illustrated by the following references: U.S. Pat. Nos. 5,204,204 to Shintani; 4,996,126 to Anno et al.; 4,977,054 to Honjo et al. and 4,598,034 to Honjo et al.

This invention was specifically formulated to function well with long life in the DCP-1 printer, which is a high speed, commercial quality product of Xeikon N.V. Some of the foregoing references are believed to result from activity to provide toner and developer for the same or generally the same printer.

DISCLOSURE OF THE INVENTION

The toner of this invention comprises a hybrid resin of polyester and polystyrene, with the polyester being the major material by weight. Additionally, the toner includes a TUFTONE HYBRID HB-L4 is a hybrid resin. A hybrid resin is one in which two separate polymers are made by thoroughly incorporating the reaction product from the first polymerization with the monomeric mixture for the second polymerization. The resulting hybrid resin has strands of the two polymers so mixed that the two resins are physically held together. TUFTONE HYBRID HB-L4 is generally about 92 percent polyester and 8 percent styrene butylacrylate copolymer by weight.

The three rainbow color pigments are transparent and color-subtractive, so that they can be applied on one another to form a range of hues by subtraction, as is standard.

HOSTAPERM Blue B2G is copper phthalocyanine blue pigment (Colour Index Pigment Blue 15:3).

CHEMISPERSE Magenta 3238 is a beta naphthol-based magenta pigment.

Pigment Yellow GG is a standard diarylide yellow pigment (Colour Index Pigment Yellow 17).

The toner is processed as follows:

Processing

1. Masterbatches of the C, Y and M pigments are prepared (40 wt/wt %) in the toner binder resin. Mixture is granulated.
2. Appropriate amount of masterbatch is added to other raw materials and the dry blend composite is homogenized in a Herschel blender uniformly distributing the various raw materials in the mixture.
3. This dry mixture is added to an extruder and melt mixed to homogeneity. The resulting composition is cooled and granulated.

4. The granulated material is further reduced in size by jet milling, followed by classification, to a median size of about 8 microns with about 3% less than 5 microns by volume.
5. The toner powder so obtained is treated with silica to promote flow and adjust charge.

This toner is combined with a carrier as follows: The carrier is a copper zinc ferrite with a volume average particle diameter of approximately 50 microns. It is coated with a silicon-based resin, specifically a copolymer of dimethylsiloxane and methylsilsesquioxane in approximately equal molar proportions.

Coating is to coat weight of 0.25% by weight, which is a coating thickness on the carrier particles of approximately 0.1 micron.

Variation of the foregoing will be apparent and can be anticipated.

We claim:

1. A xerographic toner comprising powder particles of a hybrid resin of polyester and styrene acrylate copolymer, said powder particles having thoroughly blended into them, a pigment, a charge control agent, and a fumed metal oxide.

2. The toner as in claim 1 in which said hybrid resin is generally about 92 percent polyester and 8 percent styrene butylacrylate copolymer by weight per the total weight of said hybrid.

3. The toner as in claim 2 in which said fumed metal oxide is fumed aluminum oxide in an amount of about 10 percent by weight per the total weight of said toner.

4. The toner as in claim 1 in which said fumed metal oxide is filmed aluminum oxide.

5. The toner as in claim 1 in which said pigment is a transparent color-subtractive pigment and said charge control agent is a copolymer of styrene and 2-acrylamido-2-methylpropane sulfonic acid.

6. The toner as in claim 2 in which said pigment is a transparent, color-subtractive pigment and said charge control agent is a copolymer of styrene and 2-acrylamido-2-methylpropane sulfonic acid.

7. The toner as in claim 3 in which said pigment is a transparent, color-subtractive pigment and said charge control agent is a copolymer of styrene and 2-acrylamido-2-methylpropane sulfonic acid.

8. The toner as in claim 4 in which said pigment is a transparent, color-subtractive pigment and said charge control agent is a copolymer of styrene and 2-acrylamido-2-methylpropane sulfonic acid.

9. The toner as in claim 7 in which said hybrid resin is in the amount of about 81 to 84.5 percent by weight per the total weight of said toner.

10. The toner as in claim 9 mixed with a carrier of a ferrite body having a silicone-based resin coating of approximately 0.1 micron thickness.

11. The toner as in claim 2 in which said pigment is carbon black.

12. The toner as in claim 3 in which said pigment is carbon black.

13. The toner as in claim 4 in which said pigment is carbon black.

14. The toner as in claim 11 mixed with a carrier of a ferrite body having a silicone-based resin coating of approximately 0.1 micron thickness.

* * * * *